US006116484A

United States Patent [19]

Allen

[11] Patent Number: 6,116,484

[45] **Date of Patent: *Sep. 12, 2000**

[54] ROTATABLE WRIST MOUNT SPECIAL RECEPTACLE PLATFORM FOR HOLDING AND DISPLAYING SMALL ELECTRONIC DEVICE

[76] Inventor: Robert P. Allen, 18734 Hwy. 30, #18, Hagerman, Id. 83332

[ * ] Notice: This patent is subject to a terminal disclaimer.

[21] Appl. No.: 09/388,407

[22] Filed: Sep. 1, 1999

Related U.S. Application Data

[63] Continuation-in-part of application No. 09/058,998, Apr. 13, 1998, Pat. No. 6,016,942.

[51] Int. Cl.[7] ..... A63B 69/00

[52] U.S. Cl. ..... 224/197; 224/219; 434/250

[58] Field of Search ..... 224/197, 199, 224/219, 222, 267; 434/250

[56] References Cited

U.S. PATENT DOCUMENTS

| | | | |
|---|---|---|---|
| 1,407,239 | 2/1922 | Weiss | 224/219 |
| 2,099,295 | 11/1937 | Canfield | 224/255 |
| 3,550,824 | 12/1970 | Bohanski | 224/219 |
| 4,903,932 | 2/1990 | Stewart, Jr. | 224/267 |
| 5,386,933 | 2/1995 | Greene et al. | 224/219 |
| 5,531,481 | 7/1996 | Wiltshire | 224/219 |
| 5,810,220 | 9/1998 | Peterson | 224/222 |
| 6,016,942 | 1/2000 | Allen | 224/197 |

FOREIGN PATENT DOCUMENTS

| | | | |
|---|---|---|---|
| 70777 | 2/1916 | Switzerland | 224/219 |

*Primary Examiner*—Stephen P. Garbe

[57] ABSTRACT

A special receptacle which fastens on a user's wrist for mounting small electronic devices or printed graphics.

10 Claims, 4 Drawing Sheets

ROTATABLE WRIST MOUNT SPECIAL RECEPTACLE PLATFORM FOR HOLDING AND DISPLAYING SMALL ELECTRONIC DEVICE

CROSS REFERENCE TO RELATED APPLICATIONS

This application is a continuation-in-part of prior application No. 09/058,998, filed Apr. 13, 1998, now U.S. Pat. No. 6,016,942.

STATEMENT REGARDING FEDERALLY SPONSORED RESEARCH OR DEVELOPMENT

Not applicable.

REFERENCE TO MICROFICHE APPENDIX

Not Applicable.

BACKGROUND OF THE INVENTION

1. Field of the Invention

This invention relates to the field of accessories for portable reference means. This invention is a wrist mounted rotatable platform for mounting on the platform any of most of the various hand hold size electronic devices. The platform frees the hands from holding a device. The rotation feature provides for adjustable orientation for best viewing of a display. The platform can also be used for card or paper graphics.

List of Related Art cited:

| U.S. PATENT DOCUMENTS | | | |
|---|---|---|---|
| 1,407,239 | 2/1922 | Weiss | 224/219 |
| 2,099,295 | 11/1937 | Canfield | 224/255 |
| 3,550.824 | 12/1970 | Bohanski | 224/219 |
| 4,903,932 | 2/1990 | Stewart, Jr. | 224/267 |
| 5,386,933 | 2/1995 | Greene et al. | 224/219 |
| 5,531,481 | 7/1996 | Wiltshire | 224/219 |
| 5,810,220 | 9/1998 | Peterson | 224/222 |
| 6,016,942 | 1/2000 | Allen | 224/197 |

| FOREIGN PATENT DOCUMENTS | | | | |
|---|---|---|---|---|
| 70,777 | 2/1916 | Switzerland | Maisch | 224/219 |

2. Description of the Related Art

The reference documents are related to the application of this invention in that several pertain to a device for holding something on a wrist. Differences from the subject invention which are common to each of the references is that none of them in their specific styles or size proportions are usable for mounting the current or anticipated future variety of hand hold size small electronic devices.

The foreign patent of 1916 by Maisch of Switzerland is for a leather wrist mount sketch and note pad holder with pencils. Had the designer intended to display individual printed graphics or electronic devices had they then existed, he could have if he would have sized such displays to fit his holder. However his holder concept would not accept the size of graphics or electronic devices that the subject invention is designed for, and his holder does not provide for rotatable viewing orientation.

The U.S. 1922 patent by Weiss is for a wrist mount holder for paper or erasable reusable surface note pad with pencil, and an openable windowed protective cover for writing through the windows. The concept did not contemplate holding otherwise printed graphics or electronic devices as provided for by the subject invention device.

The U.S. 1937 patent by Canfield is for a wrist mount holder for miniature paper note pads from which used sheets can be removed. The concept did not contemplate holding otherwise printed graphics or electronic devices as provided for by the subject invention device.

The U.S. 1970 patent by Bohanski is for a wrist mount rotatable holder for flashlights. The wrist mount purpose is similar to the hands freeing function of the subject invention device. And the rotatable purpose is similar to the direction orienting function of the subject invention device, except that Bohanski's rotation is held in increments of orientation by a circle of spaced mechanical bumps on its mount plate, whereas the rotation of the subject invention device is infinite as to position setting. The rotatable position hold function of the subject invention is considered to be an improvement over Bohanski's concept and that of other rivet and nut/bolt types of rotation fastenings of holders to wrist mounts, for the following reasons. The invention device any position holding functions through the close mating and surface friction between four relatively large diameter disk surfaces that are part of the wrist mount to holder assembly, as will be further explained below and through the drawings. Also the large diameters of the disks and their large diameter joining stem provide strong fastening strength, with parts that do not tear out of plastic surfaces with use such as normal diameter metal rotational fasteners can.

The U.S. 1990 patent by Stewart is for a thigh mounted holder for such as relatively large writing tablet clip boards used while seated. That the tablet holder rotates is a principal feature of the device. Eight optional position direction positions are available. The position locking device and the mount to holder fastening are strong, related to the large clip board and the strength of a leg thigh. The mechanisms are too strong and too elaborate relative to the simple light weight parts of the subject invention platform holder for use on wrists.

The U.S. 1995 patent by Greene is for mounting protectively transparent laminated ski run area maps on wrists. The laminated sandwich has cuts in the back sheet which accept wrist mounting straps. The sandwich flex curves over the wrist and its clothing. Similar to what professional football quarterbacks and coaches are presently using for play referencing. Other graphics could be individually handled with such a concept, but not equivalent to the subject invention holder with its flat graphics feature, capability for mounting small electronic devices, and rotatable features.

The U.S. 1996 patent by Wiltshire is for a small in area but relatively high miniature wrist mount memo pad device with pencil. The height of the device relates to its having a stack of miniature file drawers for storing miniature writing paper and written memos. There are several additional elaborate features on this device, but none that would reasonably relate to the rotatable platform for mounting graphic displays and hand hold size electronic devices features of the subject invention holder.

The U.S. 1998 patent by Petersen is for a small portable sorting tray for mail workers. The tray mounts on the underside of a forearm above the wrist and is rotatable. The tray mounted on the underside of the forearm permits the hand on that arm to participate in holding letter envelope sorting. A metal bolt with washers fastens the tray to the arm mount and brake holds rotation through its providing compression between mating surfaces. This fastener/position holding method is mechanically natural and is similar to that used for early versions of the subject invention holder. The present design for the rotation and fastening of the subject holder is a significant improvement, as outlined under patent by Bohanski above.

The above reference documents are indirectly related to the application of this invention in that several pertain to a device for holding something on a wrist. None of their designs are capable of mounting electronic devices or of displaying individually the graphics for which this holder is sized.

The U.S. 2000 patent by Allen is for a special receptacle which mounts on a user's wrist for holding and displaying visual aids as used by ice skaters. The patented device which is a rotatable wrist mounted tray with side walls designed for holding sets of learning aid cards for ice skating dances, is a directly related prior application. The subject new application is a continuation-in-part of the prior application. The continuation-in-part application is for a partial variation of the prior design. The variation receptacle is a rotatable wrist mounted platform without side walls, for holding hand hold size electronic devices, rather than a tray receptacle with side walls for holding sets of visual aids as in the prior application. The subject new invention can also be used to hold one at a time the learning aid cards that the prior application is designed to hold as a set.

The invention's open platform capable of mounting the variety of current and anticipated future hand hold size electronic devices, and capable of mounting individual graphics for any variety of subjects including the skater learning aid cards designed for the cross referenced tray holder, the platform holder's rotate mechanism, and its thin light weight plastic section including the platform which can be shears trimmed by a user to suit a particular electronic device, are, for holding electronic devices, improvements over the indirect references and the direct reference prior application.

BRIEF SUMMARY OF THE INVENTION

The present invention comprises a rotatable, wrist-mountable platform holder on which platform may be mounted small hand hold size electronic devices, and the platform may also be used for mounting appropriately sized card or paper graphics of any subject. The holder frees the hands of the user. The holder can be rotated on a user's wrist to orient an electronic or printed graphic for best viewing. All of the corners and edges of the holder are rounded so that it has no sharp edges.

DETAILED DESCRIPTION OF THE INVENTION

Figure 1:
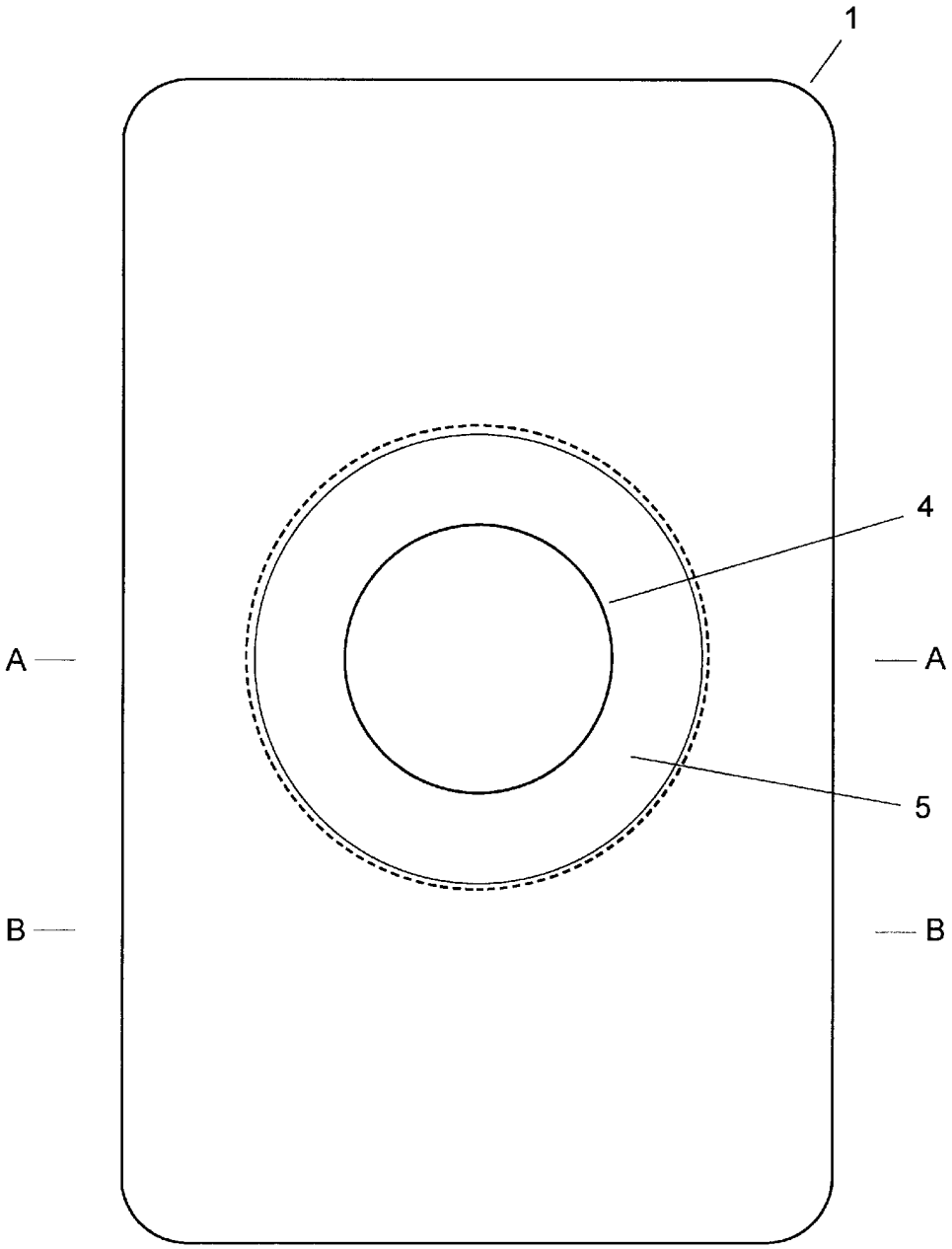
FIG. 1 is a plan view of the platform holder looking at it from its top.

Platform Holder 1 (FIG. 1) is formed from injection molded, shatterproof plastic material. The material is not brittle and not extremely rigid and may be either clear or colored. Platform Holder 1 further includes a hole 4 and a dimple recess 5. The holder is attachable to a person's wrist by means of a wrist mount assembly 25 (FIG. 4) which is rotatably mounted to the holder through hole 4 in the bottom of the platform.

Figure 12:
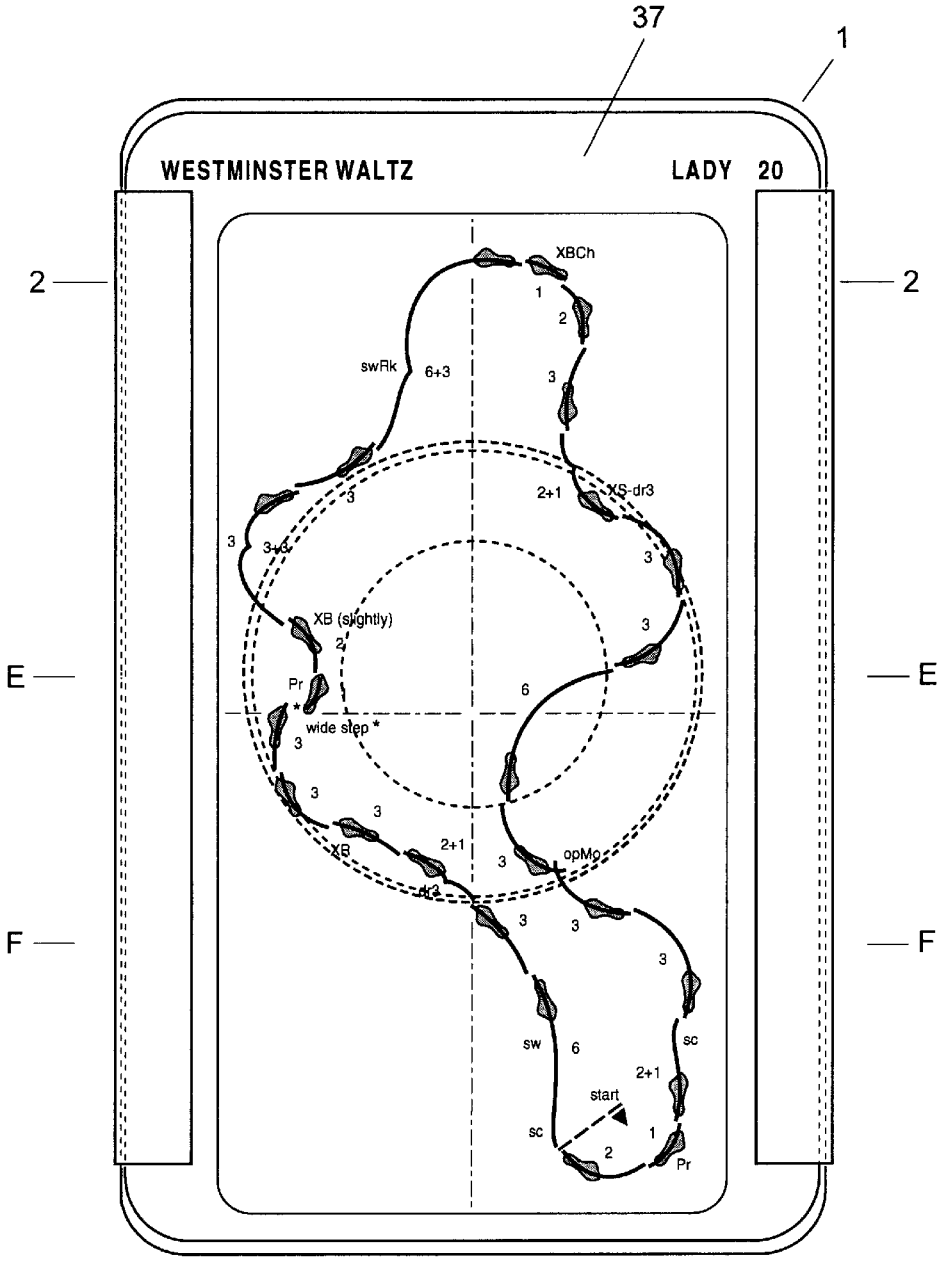
FIG. 12 is a plan view of a skater learning aid graphic card mounted on the platform of FIG. 1.
Figure 13:
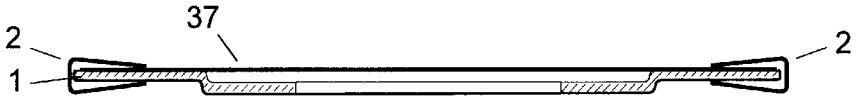
FIG. 13 is a cross section through line E—E of FIG. 12.
Figure 14:
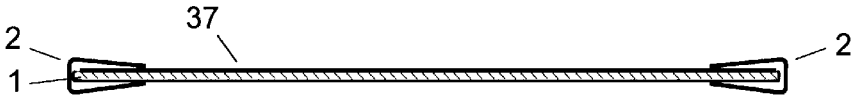
FIG. 14 is a cross section through line F—F of FIG. 12.

The presently preferred sizing of the platform holder is for 4"×6.5" corner rounded cards. This size will also accomodate most presently available hand hold size electronic devices. Sketch outline 2 (FIGS. 12,13,14) illustrates how a pair of stationers edge grip strips will slip fit on the platform to hold card or paper graphic displays. The strip size required is one half of a one edge strip as normally used for gripping regular letter size matter. Skater learning aid card 37 (FIG. 12) is typical of the cards for which the holder is sized.

Figure 9:
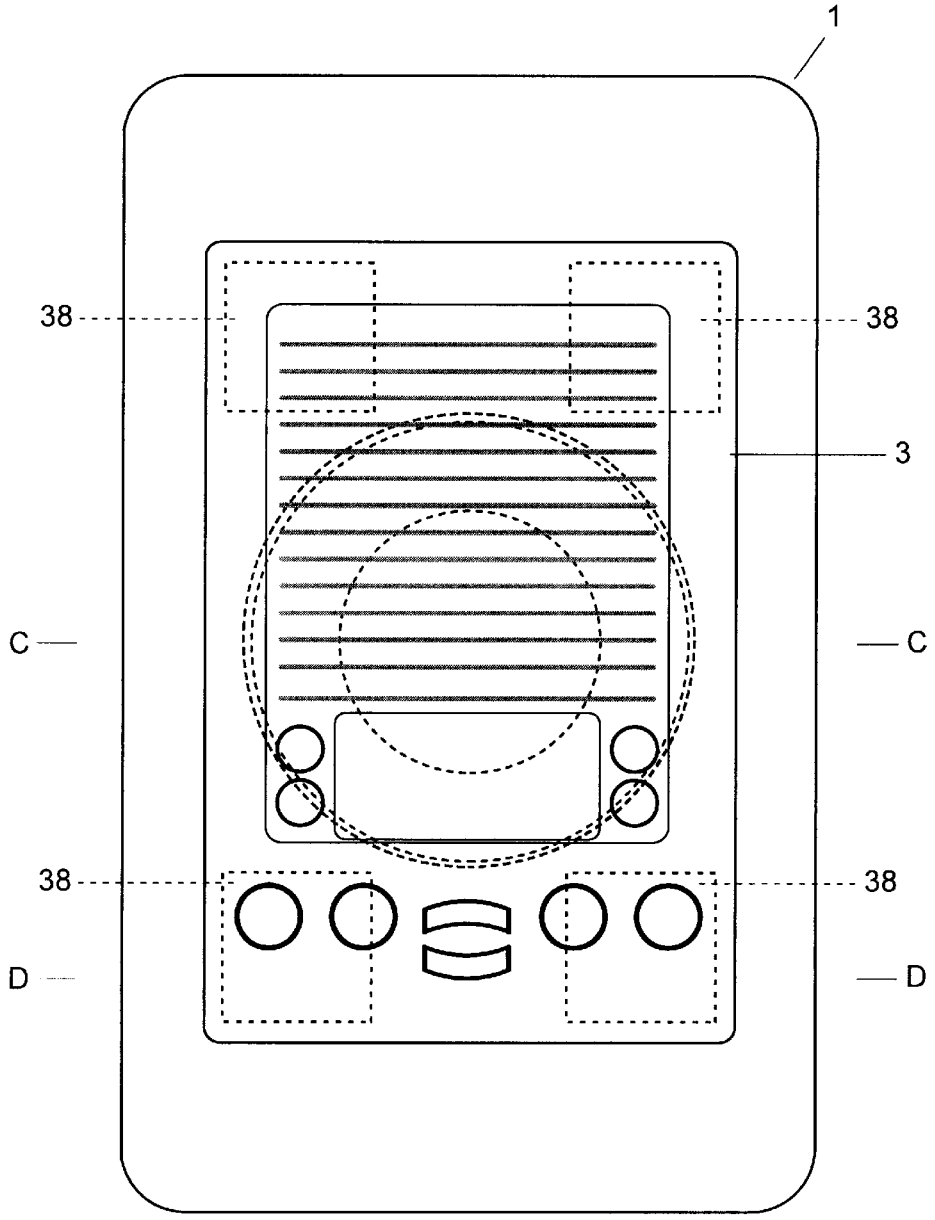
FIG. 9 is a plan view of an electronic device mounted on the platform of FIG. 1.
Figure 10:
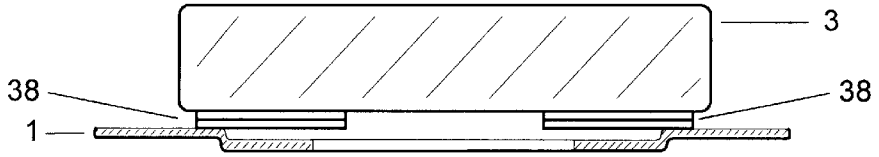
FIG. 10 is a cross section through line C—C of FIG. 9.
Figure 11:
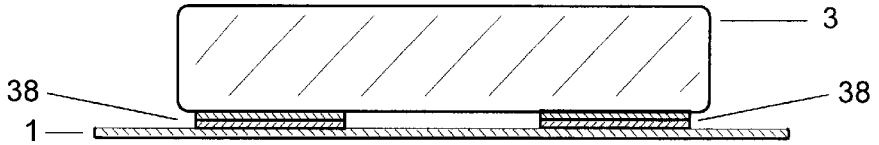
FIG. 11 is a cross section through line D—D of FIG. 9.

Electronic device sketch 3 (FIGS. 9,10,11) illustrates how the presently most popular hand hold electronic device would be positioned on the platform holder. If a user wants to dedicate a platform for only one specific size of electronic device, the user may choose to trim cut the platform outline to match the outline of the electronic device. The plastic platform can be trimmed by using a shears. Devices detachably mount on the platform by using sticky back hook and loop material patches or strips. Four of one available size of retail adhesive backed hook and loop patch pairs 38 (FIGS. 9,10,11) are sketch exampled holding electronic device 3.

Each of the corners of the platform holder 1 (FIG. 1) is curved. All edges are rounded.

Figure 2:
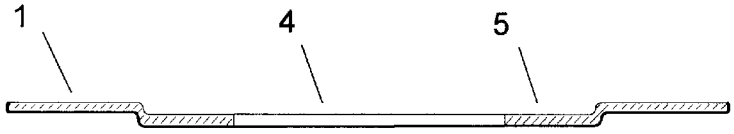
FIG. 2 is a cross section through line A—A in FIG. 1.
Figure 3:
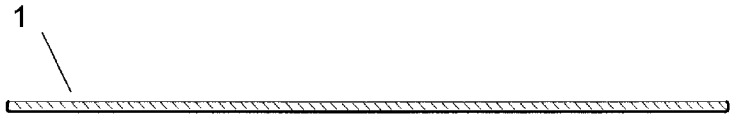
FIG. 3 is a cross section through line B—B in FIG. 1.
Figure 4:
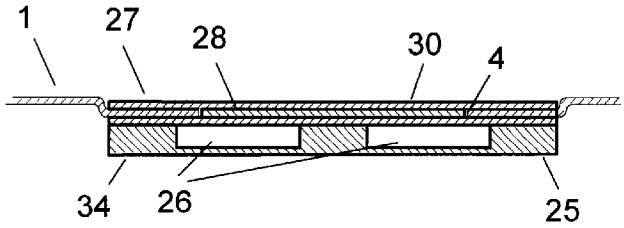
FIG. 4 is a cross section through the mount assembly when it is secured to the platform.

Hole 4 in the dimple recess 5 of the holder (FIGS. 1 and 2) allows for attachment of the wrist mount assembly 25 (FIG. 4). The dimple recess allows the wrist mount assembly to rotate beneath electronic devices or graphic printing mounted on the platform holder.

Figure 5:
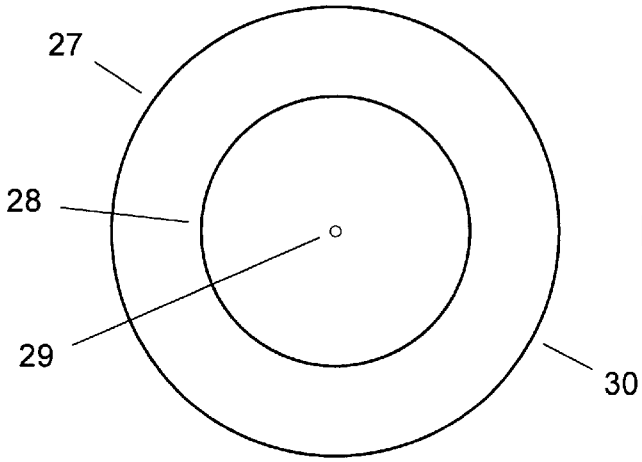
FIG. 5 is a plan view of the rivet swivel.
Figure 6:
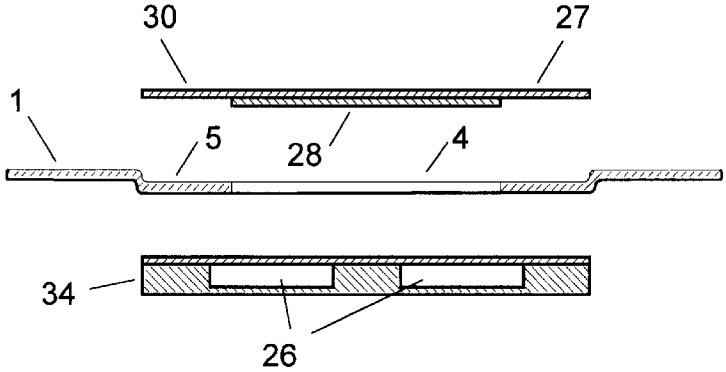
FIG. 6 is an exploded view of the rivet mount assembly and the bottom of the platform.

Wrist mount assembly 25 comprises a strap plate 34 (FIGS. 4 and 6–8), which is molded with or bonded to, disk 36, and a rivet swivel 30 (FIGS. 5 and 6), which is comprised of a rivet head 27 and a rivet stem 28. The wrist mount assembly is made from the same material as the holder and may be either injection molded or formed from sheets of plastic bonded together. The rivet stem 28 and the disk 36 are bonded together through hole 4 in the bottom of the platform 1. Friction between the mount assembly and the bottom of the holder platform is sufficient to maintain the holder in a set position but allows the holder to be rotated by hand. Each element of the wrist mount assembly includes a small centering hole 29 for facilitating accurate positioning of the mount parts prior to bonding.

Figure 7:
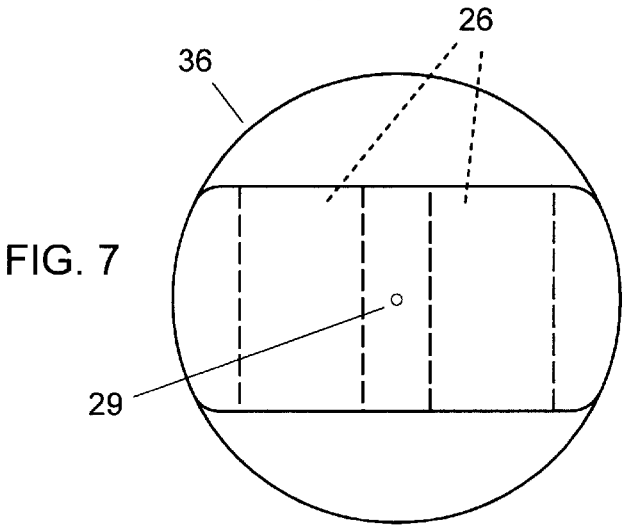
FIG. 7 is a plan view of the strap plate and the disk.
Figure 8:
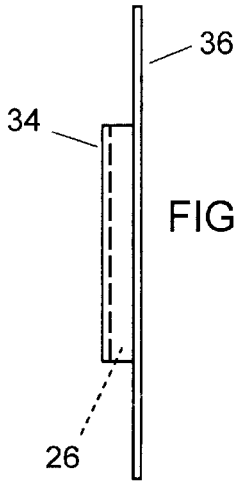
FIG. 8 is an edge view of the strap plate and disk of FIG. 7.

Strap plate 34 has curved ends which match the curvature of disk 36, as seen in FIG. 7. The strap plate includes slots 26 (FIGS. 4,7 and 8) for receiving a pair of straps or bands for attaching the holder to a user's wrist. The slots will accept various strap materials such as leather, plastic, woven, or hook and loop fasteners.

In use, wrist straps are inserted through slots 26 in strap plate 34 and the holder is attached to the wrist of a user. The straps may be applied directly to the user's wrist or may be applied over the sleeve of the user's apparel.

Claims:

1. A platform receptacle for attaching to a user's wrist, upon which may be mounted a small electronic device, or card or paper graphics, said platform receptacle comprising:

a platform upon which the electronic device or graphics may be mounted, the platform having upper and lower surfaces, the upper surface including a downwardly extending dimple with a hole extending through the dimple, a wrist mount assembly rotatably secured to the platform through said hole, the assembly including a strap plate mounted to a disk positioned under said lower surface with the disk adjacent to the lower surface, the assembly further including a rivet swivel located within the dimple adjacent said upper surface and secured to the disk through the hole, the strap plate further including a slot extending through it for receiving a wrist strap.

2. The receptacle of claim 1 wherein the receptacle and wrist mount assembly are made from molded plastic.

3. The receptacle of claim 1 wherein the strap plate includes two slots for receiving two wrist straps.

4. The receptacle of claim 1 wherein the rivet swivel includes a rivet head and a rivet stem secured together and wherein the rivet stem is secured to the disk.

5. The receptacle of claim 1 wherein the platform is made of thin plastic so that it can be trimmed to a desired size using hand shears.

6. The combination of a platform receptacle for attaching to a user's wrist while viewing graphics and a small electronic device attached to the receptacle, said receptacle including a platform having an upper surface and a lower surface with said electronic device attached to said upper surface, the upper surface including a downwardly extending dimple with a hole extending through the dimple, a wrist mount assembly rotatably secured to the platform through said hole, the assembly including a strap plate mounted to a disk and positioned under said lower surface with the disk adjacent the lower surface, the assembly further including a rivet swivel located within the dimple adjacent said upper surface and secured to the disk through the hole, the strap plate further including a slot extending through it for receiving a wrist strap.

7. The combination recited in claim 6 wherein the electronic device is removably secured to the platform by means of adhesive-backed hook and loop material.

8. The combination recited in claim 6 wherein the platform is made of thin plastic so that it can be trimmed to a desired size using hand shears.

9. The combination of a platform receptacle for attaching to a user's wrist while viewing a card or paper graphic and the graphic attached to the receptacle, said receptacle including a platform having an upper surface and a lower surface with said graphic attached to said upper surface, said upper surface including a downwardly extending dimple with a hole extending through the dimple, a wrist mount assembly rotatably secured to the platform through said hole, the assembly including a strap plate mounted to a disk and positioned under said lower surface with the disk adjacent the lower surface, the assembly further including a rivet swivel located within the dimple adjacent said upper surface and secured to the disk through the hole, the strap plate further including a slot extending through it for receiving a wrist strap.

10. The combination of claim 9 wherein the graphic is removably secured to the platform by means of a pair of edge grip strips which are slip fit onto the platform.

* * * * *